United States Patent [19]

Harris et al.

[11] Patent Number: 5,007,520

[45] Date of Patent: Apr. 16, 1991

[54] MICROPROCESSOR-CONTROLLED APPARATUS ADAPTABLE TO ENVIRONMENTAL CHANGES

[75] Inventors: Dawn E. Harris, Indianapolis; William H. Orr, Carmel, both of Ind.

[73] Assignee: AT&T Bell Laboratories, Murray Hill, N.J.

[21] Appl. No.: 368,619

[22] Filed: Jun. 20, 1989

[51] Int. Cl.[5] ..... G07D 5/08

[52] U.S. Cl. ..... 194/317; 324/225

[58] Field of Search ..... 194/317, 318, 319; 324/225, 236

[56] References Cited

U.S. PATENT DOCUMENTS

| | | | |
|---|---|---|---|
| 3,870,137 | 3/1975 | Fougere | 194/317 |
| 3,918,564 | 11/1975 | Heiman et al. | 194/318 |
| 3,918,565 | 11/1975 | Fougere et al. | 194/317 |
| 4,041,243 | 8/1977 | Zarouni | 194/216 X |
| 4,509,633 | 4/1985 | Chow | 194/334 |
| 4,534,459 | 8/1985 | Picsko | 194/346 |
| 4,538,719 | 9/1985 | Gray et al. | 324/236 X |
| 4,582,189 | 4/1986 | Schmitt | 194/317 |
| 4,601,380 | 7/1986 | Dean et al. | 194/318 |
| 4,625,078 | 11/1986 | Crouch et al. | 194/317 X |
| 4,749,074 | 6/1988 | Ueki et al. | 194/317 |
| 4,837,511 | 6/1989 | Whittington et al. | 324/236 |
| 4,838,405 | 6/1989 | Kimoto | 194/318 |

*Primary Examiner*—F. J. Bartuska

*Attorney, Agent, or Firm*—Michael A. Morra

[57] ABSTRACT

A microprocessor-controlled electronic coin chute is designed for use in a coin telephone station and adapted to operate over an extended temperature range while making coin acceptance/rejection decisions that are both rapid and accurate. Within the coin chute are a pair of coin quality sensors designed to measure a different property of a coin such as composition and size. Each coin quality sensor comprises a series-connected pair of coils placed on opposite sides of the coin path. These coils are part of an oscillator circuit having a maximum frequency when the coin is positioned between them, and an idle frequency otherwise. Idle frequency measurements are made each time an associated telephone switchhook is operated. The measured idle frequency serves as a temperature indication which, together with a stored program, is used by the microprocessor to establish acceptability limits for each coin in an allowed set. The stored program includes a predetermined functional relationship between acceptability limits and idle frequency for each allowable coin. New acceptability limits are calculated immediately after the idle frequencies are measured.

12 Claims, 5 Drawing Sheets

MICROPROCESSOR-CONTROLLED APPARATUS ADAPTABLE TO ENVIRONMENTAL CHANGES

TECHNICAL FIELD

This invention relates generally to microprocessor-controlled devices, and in particular to electronic coin chutes.

BACKGROUND OF THE INVENTION

Practically all modern electronic equipment has yielded to the incorporation of microprocessors to improve functionality and to reduce cost. Most electromechanical devices can be built using special purpose hardware such as transducers, switches, and motors that are turned on and off; plus software that tells the hardware what to do under various conditions. A microprocessor operates as an interface that controls the hardware in accordance with stored software instructions. It is important that such microprocessor-controlled devices operate properly over a broad range of environmental conditions such as wide temperature extremes, particularly in the case of a coin chute which must demonstrate high reliability because many persons become emotional when parting with their money, particularly when they receive nothing in return.

Mechanical coin chutes have been used for years in vending machines, public telephones and the like. Not only are such coin chutes bulky and expensive, they account for at least 50% of the problems associated with the equipment to which they are attached. Recently, electronic means have been used to simplify coin chute design, improve its reliability, and reduce its cost. However, electronic coin chutes (ECCs) have not been without problems such as accuracy of coin identification, and operation with a limited amount of electrical power. Keeping prices competitive with the mechanical designs that have been around for years was quite challenging initially. However, price reductions of microprocessors and associated memory devices have made lower cost and improved functionality a routine matter.

Nevertheless, reliability of identification for a wide variety of coins still presents a challenge for designers, particularly in those parts of a country where similar foreign coins of lesser denomination are readily available. This challenge is particularly difficult when accuracy over a broad temperature range is needed such as in the case of outdoor vending machines and public telephones. Coin quality sensing circuits can be specifically designed to be insensitive to temperature change; however, in view of the high accuracy requirements needed for coin handling, these circuits tend to be expensive and only compensate a portion of the temperature range.

The time that a coin remains within the coin path of an ECC is minimal because the coin path is typically free from obstructions. Indeed, most ECCs have only one moving part—the coin diverter—which is used to either return a coin to the depositor or divert it into a collection box. This decision must be made after the final quality sensor has examined the coin, and in sufficient time to operate the mechanical coin diverter. Such decisions normally require a microprocessor having great speed which leads to high cost and increased power consumption.

U.S. Pat. No. 3,198,564 discloses a technique in which a comparison is made between a measured value (such as frequency) of a coin quality sensor when a coin is in its presence, and when a coin is not. These values are examined and a signal (such as their arithmetic difference) is transmitted to a comparison and memory circuit. The comparison and memory circuit contains information regarding values for valid coins, and means for comparing such values with the transmitted signal. This approach assumes that the difference in characteristics remains constant with temperature, which it does not. Further, should the information regarding values for valid coins include a temperature look-up table for each of the various allowable coins, then the required memory space and microprocessor speed required to carry out the necessary calculations could be prohibitive in view of (i) cost, (ii) time available to perform calculations before an accept/reject decision on a coin must be made, and (iii) limited electrical power available in a line-powered public telephone application.

SUMMARY OF THE INVENTION

In accordance with the invention, a microprocessor-controlled electronic coin chute includes a stored program for operating the ECC, and means for periodically measuring an environmentally-dependent parameter. This measurement is used to modify the stored program which contains an algorithm relating the parameter to the operation of the ECC.

In an illustrative embodiment of the invention, the ECC includes one or more coin quality sensors and a stored program for determining acceptability of an allowed set of coins. The coin quality sensor comprises an oscillator circuit having a pair of coils on opposite sides of a coin path within the ECC. A first frequency is produced when the coin is away from the coil-pair and a second frequency is produced when the coin is positioned between the coil-pair. The stored program causes the processor to periodically calculate new acceptance limits for each member of the allowed set of coins. The acceptance limits are a function of a predetermined algorithm and the first frequency. Thereafter, the second frequency is compared with the acceptance limits.

In the illustrative embodiment of the invention, pulses from a high frequency source are counted between zero-crossings of each coin quality oscillator. The stored program includes reference temperature measurements (typically room temperature) of the number of pulses counted with the coin in the vicinity of each sensor and with the coin away from each sensor. The algorithm used prescribes a linear relationship between each upper and lower acceptability limit and the number of pulses counted.

It is a feature of the present invention that acceptance limits for coins are not fixed; but rather, they are dynamically calculated at the time of use in accordance with previously determined temperature/frequency relationships for the particular ECC design.

DETAILED DESCRIPTION

GENERAL

Figure 1:
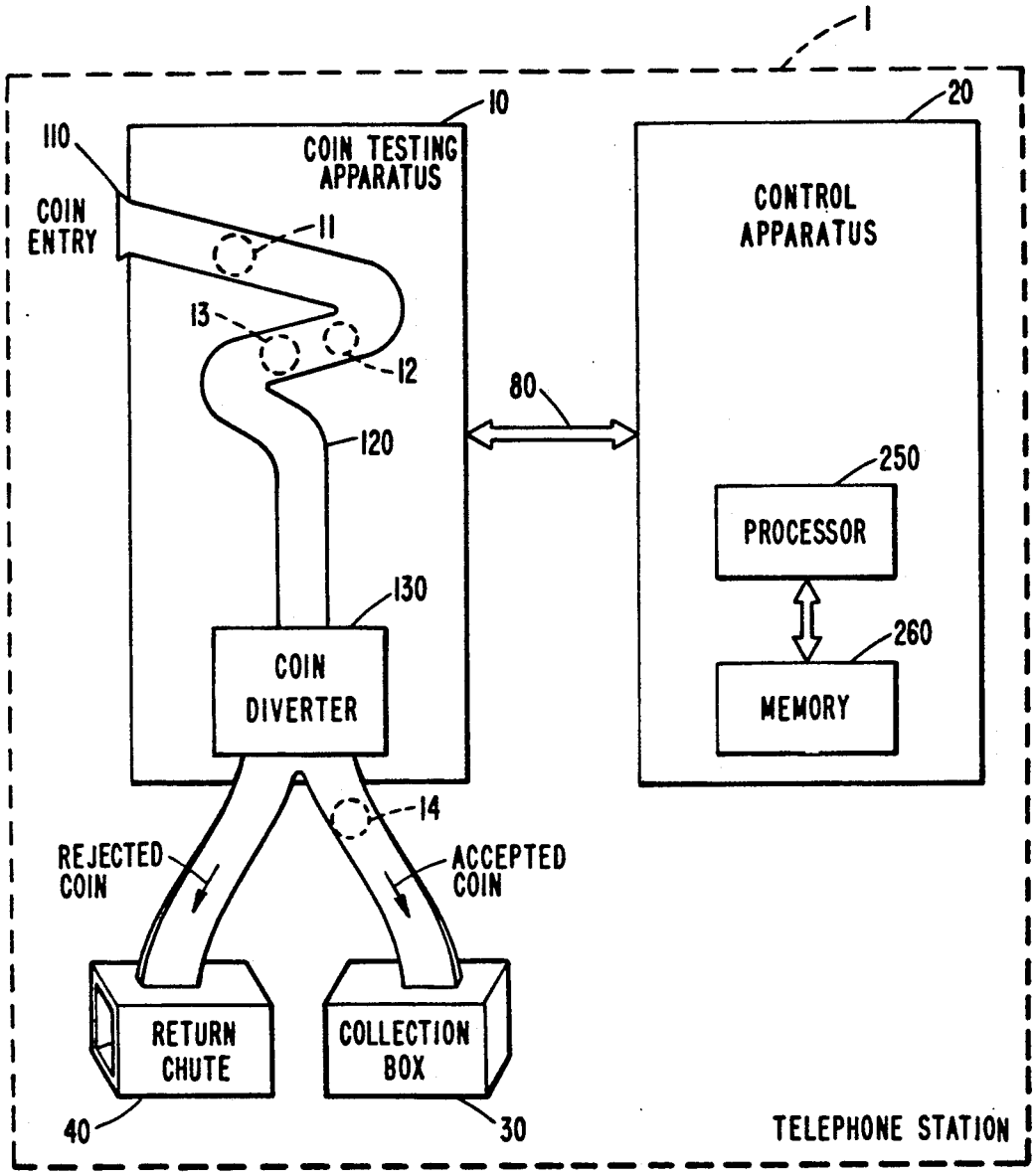
FIG. 1 illustrates the functional elements typically present in electronic coin validation equipment such as in a telephone station.
Figure 2:
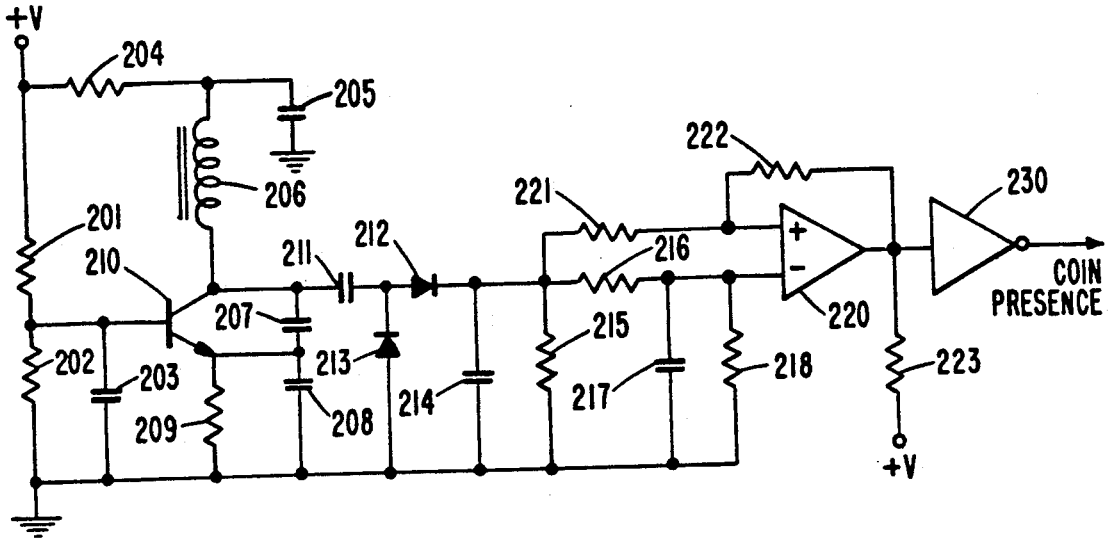
FIG. 2 discloses a schematic drawing of an oscillator circuit used in the present invention to determine coin quality.
Figure 3:
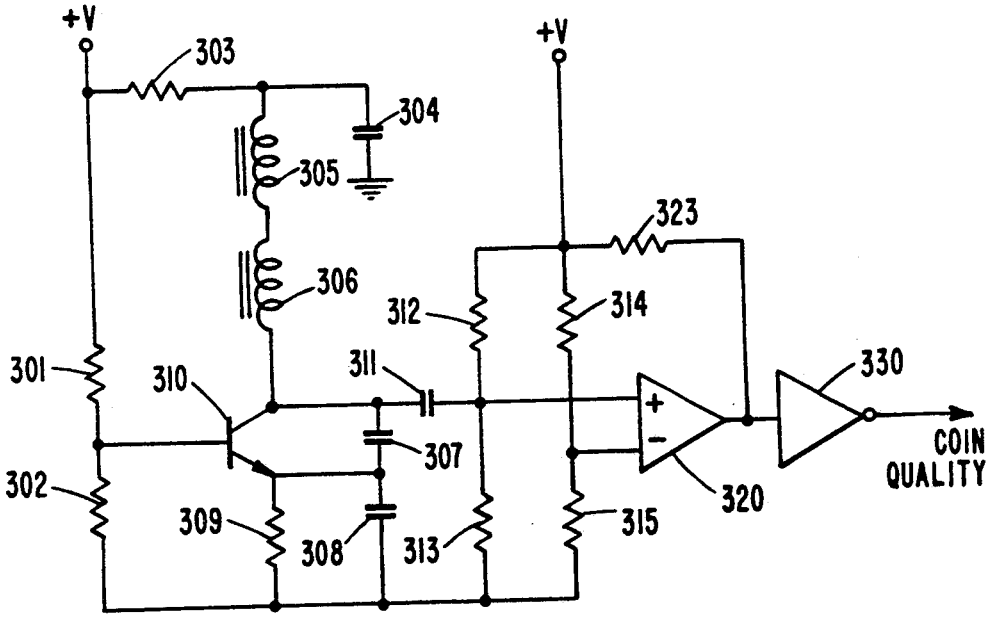
FIG. 3 discloses a schematic drawing of an oscillator circuit used in the present invention to determine coin quality.

The electronic coin validation equipment of FIG. 1, such as contained within telephone station 1, includes coin testing apparatus 10 and control apparatus 20. The latter, in particular, includes processor 250 which controls virtually all operations of the equipment in accordance with a program stored in associated memory 260. Memory 260 may either be part of processor 210 or a separate device. Control apparatus 20 further includes one or more oscillator circuits, such as shown in FIGS. 2 and 3, plus a drive circuit for operating coin diverter 130. Processor 250 monitors the frequency of these oscillator circuits and other input signals in accordance with a program stored in memory 260. In response, the processor 250 causes the coin diverter 130 to be activated or de-activated via the drive circuit.

In connection with FIG. 1, coin presence detector 11 determines when a coin has been inserted into coin entry, or slot, 110. Detector 11 comprises a coil which is part of an oscillator circuit contained within control apparatus 20. Coin quality sensors 12 and 13 each comprise a pair of coils that are part of a second oscillator circuit contained within control apparatus 20. As discussed previously, coin quality sensors 12 and 13 are used in identifying the type of coin traversing coin path 120. Finally, after a coin has been accepted, it is routed to collection box 30. Coin presence detector 14 is positioned to monitor coins entering the collection box. Detector 14 is substantially identical to detector 11 in that it comprises a single coil which is part of an oscillator circuit contained within control apparatus 20. Coin presence is determined by measuring changes in the amplitude of the signal generated by the associated oscillator circuit, whereas coin quality is determined by measuring changes in the frequency of that signal. Additionally, the frequency of the oscillator associated with coin presence detector 14 is monitored to determine when the collection box 30 is full. When a coin is unable to fully enter the collection box, it will remain in the vicinity of detector 14 and cause a permanent frequency shift in the associated oscillator. This event can be used to turn on a light to indicate that the equipment is no longer functional; transmit a signal to a remote location such as disclosed in U.S. Pat. No. 4,041,243; and/or cause the coin diverter 130 to route all inserted coins to return chute 40. These functions, and variations thereof, are a matter of design choice.

Electronic coin processing offers a number of advantages over mechanical devices. These advantages are primarily attributable to the availability of small, inexpensive microprocessors and associated memories. Such advantages include improved reliability, lower cost and weight, programmable coin validation parameters, and generally simpler construction. Electrical and optical transducers measure various properties of a coin as it travels along a generally unobstructed path toward either a return chute or a collection box.

Coins of various denominations are inserted into slot 110 which is sized to admit only a set of coins having a predetermined maximum diameter and/or thickness. Such preliminary screening is, illustratively, the only mechanical measurement performed on the coin. The remaining measurements are performed electrically, and for the purpose of determining the identity of the coin. Once identified, the coin is either delivered to collection box 30 or returned to the depositor through return chute 40 because it is not a member of the allowed set.

Control apparatus 20 exchanges electrical signals with coin testing apparatus 10 during a validation operation which generally takes less than one second to complete. The controller senses the presence of a coin as it rolls along a continuously descending ramp at a speed determined by the slope of the ramp and the parameters of the coin. Some apparatus are adapted to determine the diameter of the coin by measuring its average velocity (see e.g., U.S. Pat. No. 4,509,633). Generally, however, the parameters of a coin are determined by pairs of coils placed along the coin path. Each pair of coils is intended to measure a single property of the coin, and each member of the coil-pair is located on an opposite side of the coin path facing the other member of the coil-pair so that the coin must pass between them. The coil-pair is generally part of an oscillator circuit whose frequency, phase or amplitude is modified by the presence of the coin. Such variations are caused by changes in inductance. From electromagnetic theory, a mathematical expression can be derived to determine the fractional change in inductance $\Delta L/L$ of a circular coil when a coin is placed along its axis:

$$\Delta L/L = \frac{\pi(r_c r_\epsilon)^3[1 - \exp(-t/\delta)]}{2(1 - z^2/r_\epsilon^2)^3[\ln(8r_\epsilon/a) - 2]}$$

where:

$r_c$=radius of the coin $r_\epsilon$=radius of the coil t=thickness of the coin $\delta$=skin depth in material of coin z=coin-coil spacing (along axes)

a=wire radius and $$\delta = \frac{1}{\sqrt{f\pi\mu\sigma}}$$

where:

f=operating frequency of coil $\mu$=permeability of coin $\sigma$=conductivity of coin As a practical matter, the sizes of the coils are selected depending on the property of the coin that is being tested. For example, to test the composition of a coin, the coil size has to be small enough to be covered entirely by all coins. Also, sensitivity is greatest when the coil-coin gap is smallest. In this case, limitations are due to the thickness of the thickest coin and the material used in forming the walls of the coin chute. The frequency of operation is related to the particular property being measured. High frequencies do not penetrate the material of the coin very deeply. The skin depth at 200 kHz in 70-30 Cu-Ni alloy — used in United States coins — is 0.025 inches. The thickness of the cladding on a United States 25-cent coin is 0.011 inches. Although frequencies of 200 kHz and higher are not affected by the bulk properties of the coin (thickness and composition), they can be used for diameter measurement. For composition testing, a lower frequency is desirable so that the electromagnetic field can penetrate the bulk of the coin. A frequency of 20 kHz has a skin depth of 0.08 inches in 70-30 Cu-Ni alloy. U.S. Pat. No. 3,870,137 discusses the use of two oscillating electromagnetic fields, operating at substantially different frequencies, for examining the acceptability of coins. Typically, size and composition measurements are sufficient to uniquely identify a coin. Obviously, other properties exist such as weight, thickness, engraving marks, etc., which could be considered if the level of coin fraud exceeds the cost of implementation or if several coins in the allowed set have great similarity. Once the coin has traversed path 120 within coin testing apparatus 10, control apparatus 20 decides whether to accept or reject the coin. Its decision is sent to coin diverter 130 whose design is well known in the art. Examples of such equipment are disclosed in U.S. Pat. Nos. 4,534,459 and 4,582,189.

Coin Chute Operation

FIG. 2 discloses a circuit used in detecting the presence of a coin such used in connection with detectors 11 and 14 of FIG. 1. As noted above, detector 11 provides an indication that a coin has entered the chute while detector 14 indicates that the coin has been collected. The coin presence circuit comprises a modified Colpitts oscillator. Resistors 201 and 202 provide DC bias for transistor 210 while capacitor 203 provides an AC ground at the transistor 210 base. Resistor 204 and capacitor 205 are used to filter the power supply voltage. Inductor (coil) 206 cooperates with capacitors 207 and 208 in setting the frequency of oscillation. Emitter resistor 209 limits the current through transistor 210. Capacitor 211 couples the output of the oscillator to a voltage doubler comprising diodes 212, 213 and capacitor 214. Resistor 215 supplies a discharge path for capacitor 214 having a short time constant. A longer time constant is provided by components 216–218. Comparator 220 compares the relative amplitudes of its two AC input signals. The longer time constant signal, into its inverting input, serves as a reference signal against which the shorter time constant signal is compared. The presence of a coin in the vicinity of coil 206 causes an increase in frequency of the signal out of transistor 210 as well as a decrease in its amplitude. Thus, the output of comparator 220 goes low when a coin transits past coil 206. Resistors 221 and 222 provide a feedback path for regulating the gain of comparator 220. Component 223 is a pull-up resistor for comparator 220 which has an open-collector output. Schmitt trigger 230 is a buffer circuit between the comparator and processor 250 shown in FIG. 1.

FIG. 3 discloses a circuit used in detecting coin qualities such as composition or size. This circuit is used in connection with sensors 12 and 13 of FIG. 1. Sensor 12 detects the composition of a coin while sensor 13 detects its size. The coin quality circuit of FIG. 3 comprises a modified Colpitts oscillator whose frequency is chosen in accordance with the quality to be measured as discussed above and in U.S. Pat. No. 3,870,137. Resistors 301 and 302 provide DC bias for transistor 310. Resistor 303 and capacitor 304 are used to filter the power supply voltage. Inductors (coils) 305 and 306 cooperate with capacitors 307 and 308 in setting the frequency of oscillation. It is noted that these coils are placed on opposite sides of the coin path so that the coin must pass between them (and thereby alter the oscillator's frequency) as it moves along its path. Emitter resistor 309 limits the current through transistor 310. Capacitor 311 couples the output of the oscillator to comparator 320 which converts a sinusoidal signal into a square wave. Resistors 312–315 operate to provide DC bias voltages to the input leads of comparator 320. The inverting input is biased at a slightly higher positive voltage than the non-inverting input. Component 323 is a pull-up resistor for comparator 320 which has an open-collector output. Schmitt trigger 330 is a buffer circuit between the comparator and a counter which is discussed in connection with FIG. 4.

Figure 4:
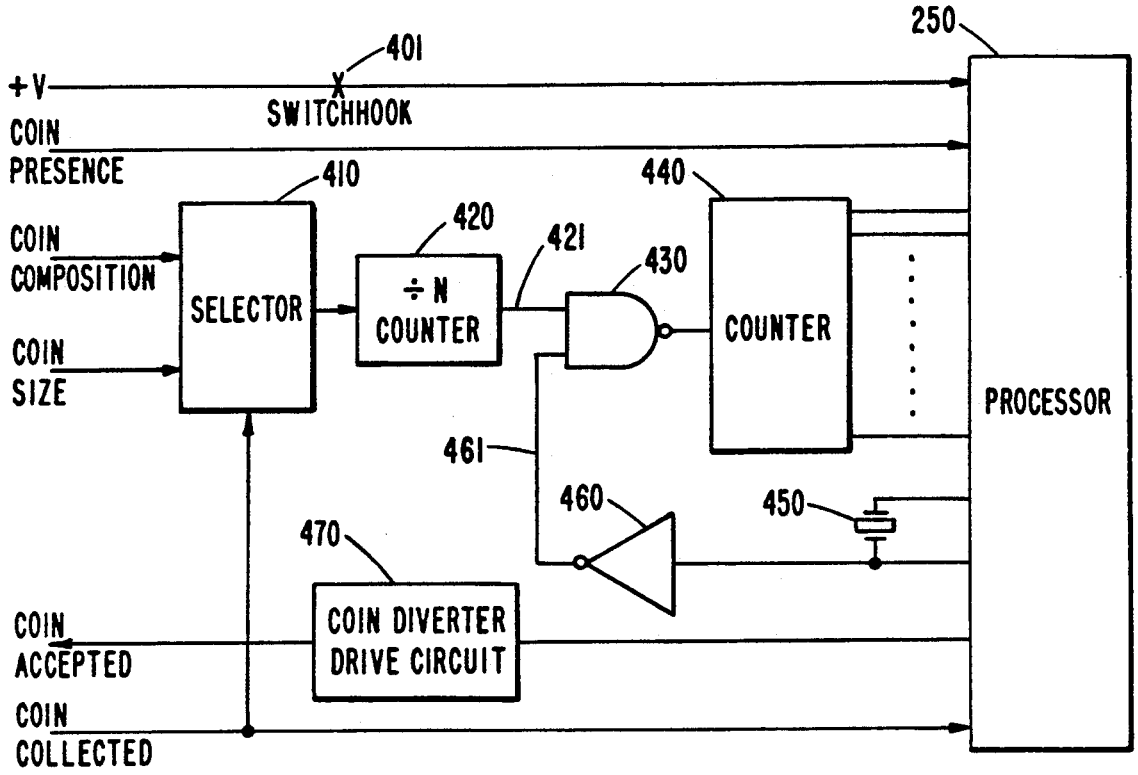
FIG. 4 discloses a block diagram that illustrates the cooperation between the processor and the various coin sensors in accordance with the invention.

FIG. 4 is a block diagram of circuitry within control apparatus 20. In particular, processor 250 is a 4-bit CMOS microcomputer such as the NEC 7508H in which system clock is provided by connecting ceramic resonator 450 across a pair of its input terminals. This resonator operates at 2.46 MHz and delivers a signal to Schmitt trigger 460 which "squares" the signal and delivers it to nand gate 430. In the present embodiment, it is not the frequency change of each coin quality oscillator that is used; rather, an approximation of the reciprocal of this frequency is used. The measurement proceeds by counting the number of pulses from an independent high frequency source that occur between zero crossings of the coin quality oscillator signal. More particularly, gate 430 is enabled by a logic "1" signal on lead 421 to transmit pulses of the 2.46 MHz signal present on lead 461. These pulses are counted in binary counter 440 which delivers a 10-bit wide parallel output signal to processor 250. This parallel output signal provides a measure of the duration between a selected number of zero crossings of the coin quality oscillator signal. Since the frequency of the coin composition oscillator and the frequency of the coin size oscillator are different, and since it is convenient to use a similar number of pulses for each of the coin quality oscillators, counter 420 divides the frequency of the signal on input lead 411 by "N." This corresponds to the number of 2.46 MHz pulses contained in 2 cycles of the composition oscillator, 20 cycles of the size oscillator, or 20 cycles of the coin collected oscillator. Processor 250 controls both selector 410 and counter 420 with leads (not shown) that select the particular sensor and then associate with it an appropriate value of N.

Figure 5:
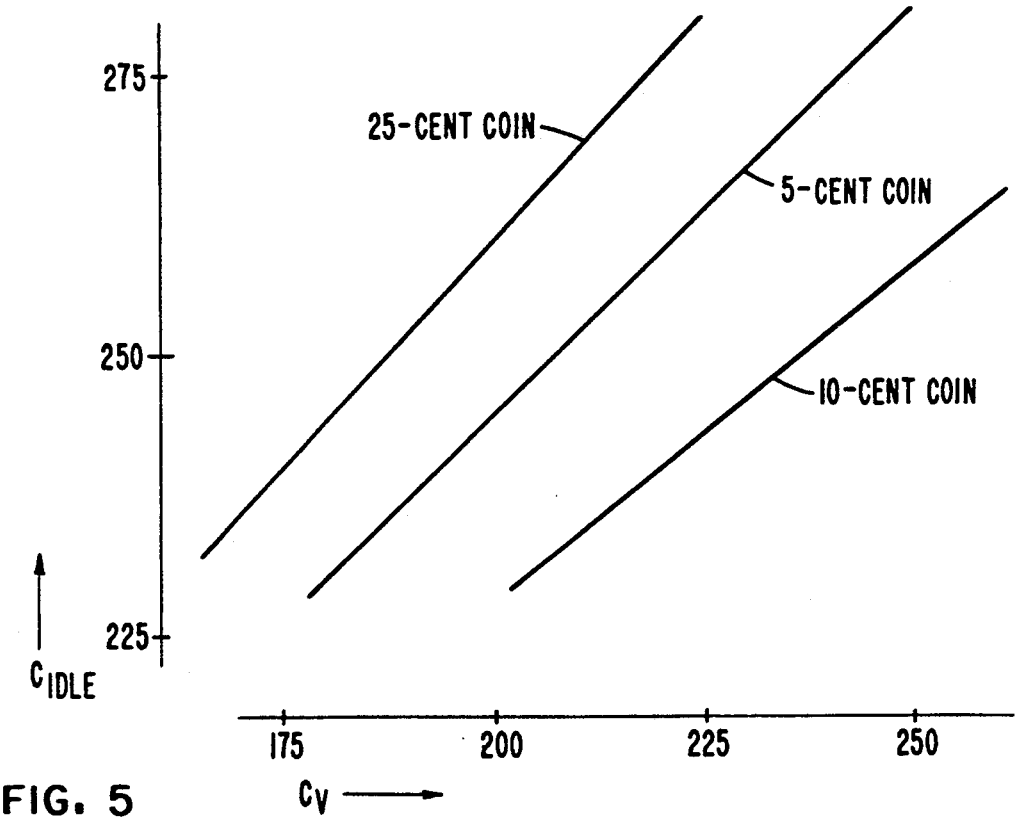
FIG. 5 is a graph that illustrates the relationship between the number of pulses counted $C_{IDLE}$ when a coin is away from a coin quality (size) sensor and the number of pulses counted $C_V$ when the coin is in the vicinity of the sensor.

So that the significance of counting high frequency pulses between zero crossings of the coin quality oscillator can be appreciated, FIG. 5 illustrates the relationship between the number of pulses counted ($C_{IDLE}$) when the coin is away from the coin quality sensor and the number of pulses counted ($C_V$) when the coin is in the vicinity of the sensor at various temperatures. Since temperature changes operate to change $C_{IDLE}$ in a nonlinear manner, and since a direct knowledge of the temperature is unnecessary in authenticating coins, temperatures are not shown in FIG. 5. It is sufficient to say that in the illustrative embodiment of the invention, increases in temperature cause the frequency of each coin quality oscillator to decrease; hence, the number of pulses counted between zero crossings will increase with temperature.

It has been determined that for a particular coin (25-cent, 10-cent, or 5-cent coin) that $C_{IDLE}=MC_V+b$, where M and b are constants. Once these constants are determined for a particular ECC design, they can be stored in memory. The relationships shown in FIG. 5 only deal with coin size measurements that are made at high frequencies (e.g., 200 kHz) which do not penetrate the material of the coin very deeply. Similar relationships exist that deal with coin composition measurements that are made at low frequencies (e.g. 20 kHz) which penetrate the coin being tested. Further, associated with each coin are tolerances that must be included in any identification algorithm to account for wear due to repeated handling.

Recognizing that slope M is a function of the difference in $C_{IDLE}$ at two different temperatures divided by the difference in $C_V$ at these same temperatures, an algorithm is constructed based on measured differences in $C_{IDLE}$ where one of the measurements is made in a factory at a reference temperature while the other measurement is made at the ambient temperature of the ECC at the time of operation. Although in the present embodiment, $C_{IDLE}$ is measured as soon as a coin is detected by coin presence detector 11 (see FIG. 1), $C_{IDLE}$ can be periodically measured and the latest measurement stored.

The following algorithm is used in determining upper and lower limits for each of the quality sensors and for each coin denomination:

$$C_{VU}=k(\Delta C_{IDLE})+C_{VR}+T$$

$$C_{VL}=k(\Delta C_{IDLE})+C_{VR}-T$$

where:

k=a constant of proportionality $\Delta C_{IDLE}$=the difference between $C_{IDLE}$ at a reference temperature and $C_{IDLE}$ at or about the time of coin authentication;

$C_{VR}=C_V$ as measured at a reference temperature; and

T=tolerance in the upper and lower limits.

Note that different values of k, T and $C_{VR}$ exist for each different coin in the allowed set and for each coin quality sensor. For example, if three coins are in the allowed set and two coin quality sensors are used, then six different values are stored for each k, T and $C_{VR}$. However, only two values of $C_{IDLE}$, measured at the reference temperature, need to be stored—one for each quality oscillator.

Since the ECC already uses a microprocessor to control other aspects of its operation, it is cost effective to further use the microprocessor to calculate new acceptance limits for each coin, from time to time, in accordance with a stored program. The stored program is designed to change the acceptance limits in accordance with changes in one or more environmentally-dependent parameters. In the present invention, temperature changes are indirectly measured and used to modify the acceptance limits.

Sequence of Operations

Figure 6:
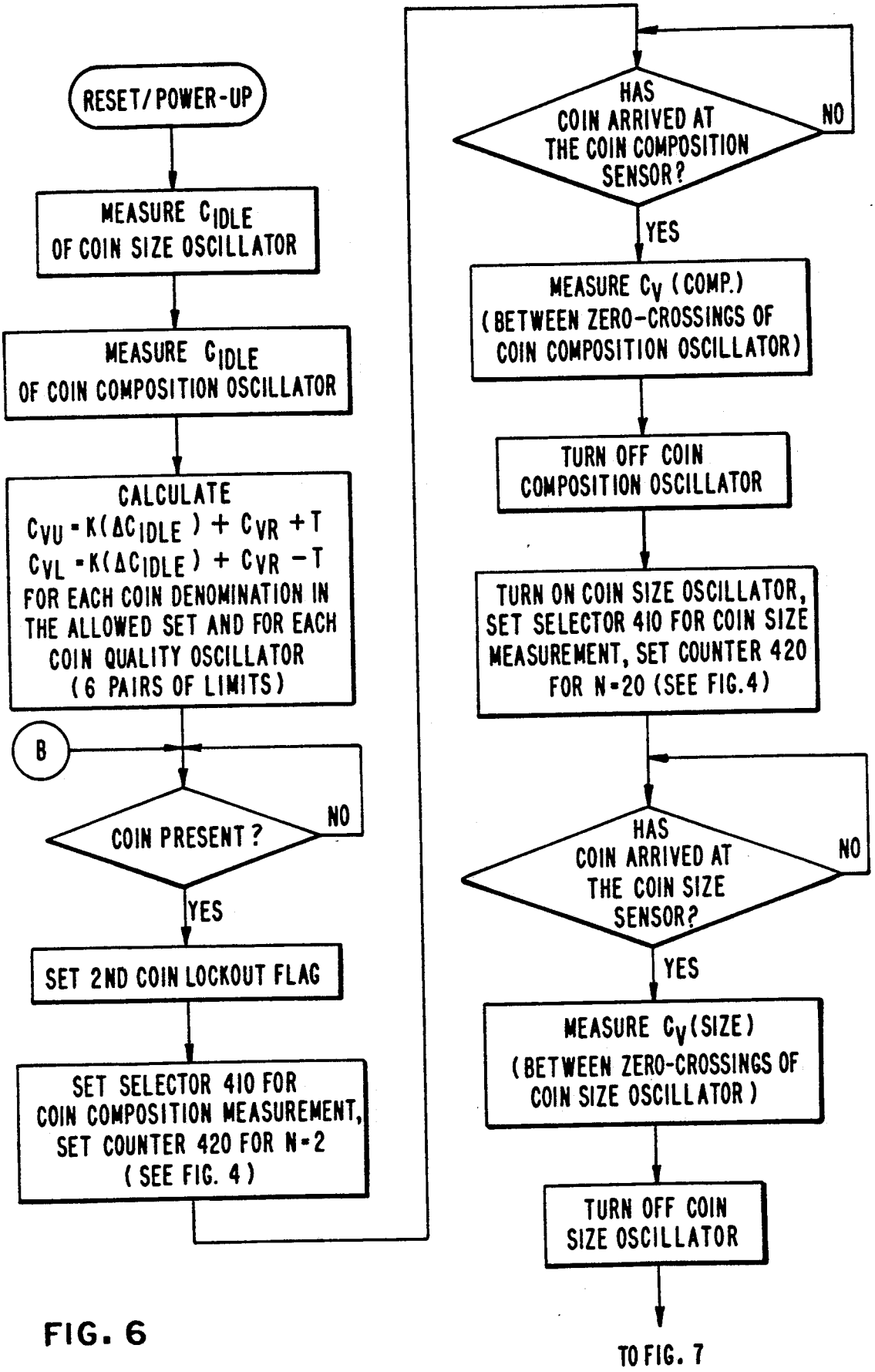
FIGS. 6–7 is a flow chart that illustrates the operation of the microprocessor as determined by the stored program.
Figure 7:
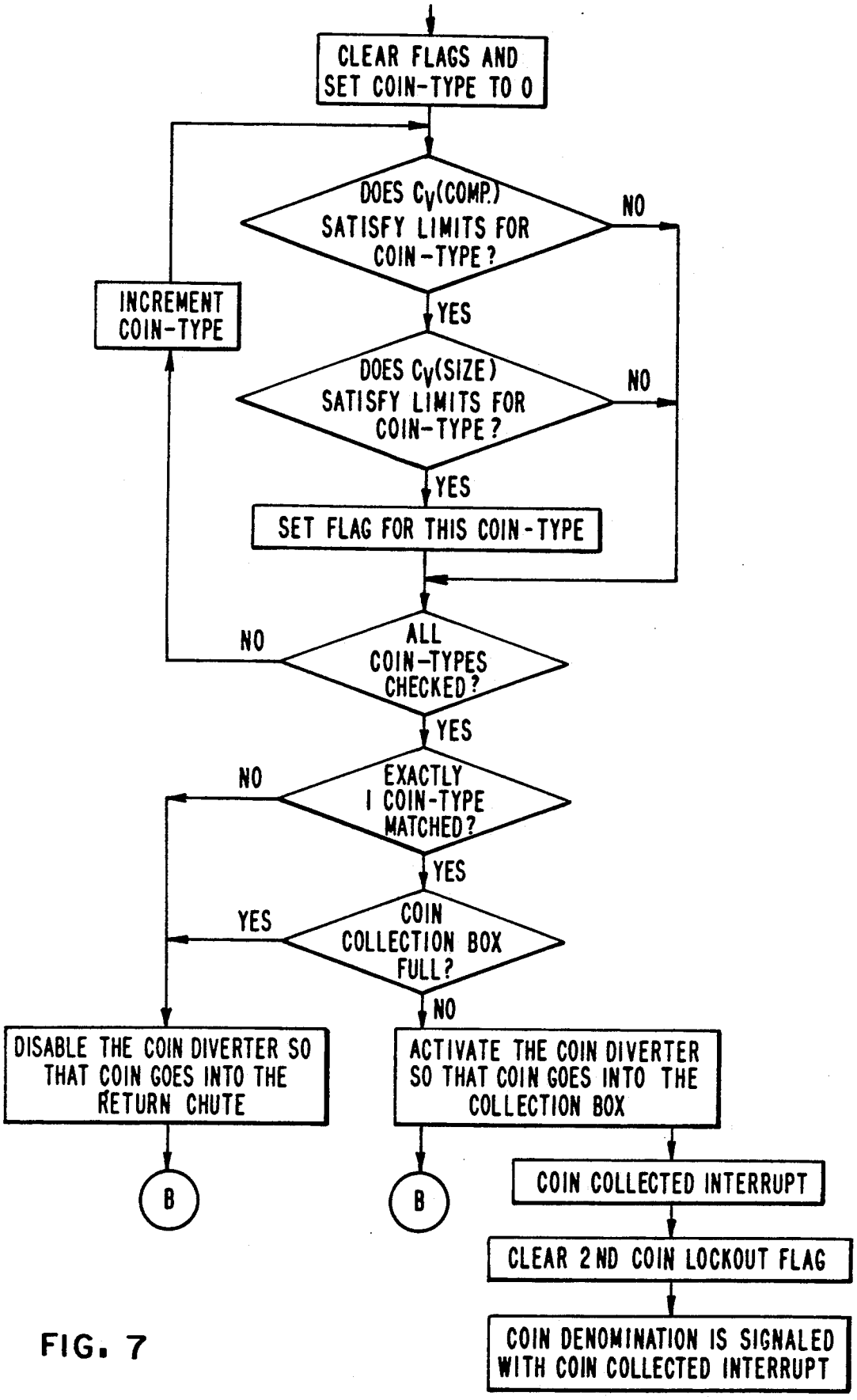

FIG. 6–7 is a flow chart that illustrates the operation of the microprocessor under control of the stored program. In a typical ECC, the elapsed time between coin insertion and the event that the coin is in the vicinity of a coin quality sensor is approximately 350 ms. This is a relatively short time interval to complete measurements of the pulse count ($C_{IDLE}$) for the coin composition oscillator and the coin size oscillator as well as the recalculation of six pairs of acceptability limits. As has been previously indicated, certain measurements and calculations may be periodically made. In order to minimize the required speed for the microprocessor, thus minimizing its cost and power consumption, measurements of ambient temperature and associated calculations may be made by the microprocessor as it performs "background" tasks that take place when the coin chute is not in active use. Such measurements may be several minutes old without significantly affecting overall accuracy because environmental conditions change rather slowly. In the case of a public telephone, the microprocessor is advantageously alerted that a coin is about to be inserted into the slot when the user activates the switchhook 401 (see FIG. 4). Switchhook mechanisms are well known in the telephone design art and typically include a number of switches, some being opened and others being closed upon activation. The microprocessor responds to one of these switches to commence measurements and calculations as indicated by the first (Reset/Power-up) state shown in the flow chart of FIG. 6.

Continuing through the flow chart, $C_{IDLE}$ is measured for both the coin composition oscillator and the coin size oscillator. Finally, the acceptance limits for each coin-type are calculated based on the stored algorithm. Note that the change in idle frequency count, $\Delta C_{IDLE}$, represents the change in frequency between the factory reference measurement and the present measurement. Any frequency difference is primarily attributable to temperature changes. The constant "k" and the tolerance "T" were selected during the design of the coin chute to modify the acceptance limits, in accordance with temperature changes, of the pulse count $C_V$ while the coin is in the vicinity of the quality sensor.

The program waits at this time until coin presence detector 11 (see FIG. 1) signals that a coin has entered the chute. A lockout flag is set that precludes acceptance of a second coin until certain steps are completed. Power is applied to the coin composition oscillator, and selector 410 (see FIG. 4) is adapted to transmit the output signal from this oscillator to counter 420 whose value of N is set equal to 2. Processor 250 monitors the number of pulses of a 2.46 MHz source that are counted during each successive N cycles of the signal delivered to the input of counter 420. Decreasing measurements of pulse count indicate that the coin is moving under the influence of the composition sensor. The measurements of pulse count continue to decrease until a minimum is reached (maximum frequency). The minimum pulse count, $C_V$, occurs when the coin is under the maximum influence of the sensor and its magnitude is stored.

The coin composition oscillator is now turned off and the coin size oscillator is turned on. With limited power available, only one oscillator is turned-on at a time. Substantially the same process is used for the coin size measurement as for the coin composition measurement except that N is now set equal to 20 After the minimum count for $C_V$ is obtained for coin size measurement, the coin size oscillator is turned off and comparisons of the recently acquired values for $C_V$ are now compared with its previously established limits; FIG. 7 sets forth the various steps used in making the comparison.

In the illustrative embodiment, the limit values for each coin-type are individually presented for comparison with $C_V$. A flag is set for each coin-type where $C_V$ satisfies both composition and size limits. After each of the coin-type limits are presented for comparison there must only be a single flag that is set, otherwise the coin will not be accepted. Furthermore, if the collection box is full, the coin will not be accepted. After these comparisons have completed, the lockout flag is cleared—allowing the next coin to be inserted.

Assuming that the coin passes all the necessary tests, coin diverter 130 (see FIG. 1) is activated to direct the coin into the collection box 30. Coin presence detector 14 is activated as a coin passes it on the way to the collection box. Information regarding the denomination of coins in the collection box is available to the microprocessor. So long as the telephone station remains off-hook the stored program awaits insertion of the next coin (state "B" in the flow chart) and continues to use the acceptance limits established during Reset/Power-up.

The present invention is not limited to temperature variations; it encompasses any electronic coin chute that modifies a stored program in accordance with a measured environmental parameter. Thereafter, the stored program participates in the operation of the ECC. Environmental parameters include, but are not limited to, temperature, altitude, humidity and pressure. Further, environmental parameters may be directly or indirectly measured. Additionally, coin presence detectors may be implemented by other means; for example, light emitting diodes and photodetectors may be used in the coin path, rather than oscillating electromagnetic fields, without departing from the spirit and scope of the invention.

We claim:

1. A telephone station adapted to receive coins in a collection box as payment for telephone calls made by a user, the telephone station including a coin chute having a pair of sensors, each associated with a self-resonant oscillator that generates a signal whose frequency varies in accordance with a predetermined quality of the coin, said oscillators operating at different frequencies, a microprocessor having a stored program for determining coin acceptability, and a signaling device, characterized by:

means for measuring the frequency of each oscillator at the time when the signaling device is operated;

means responsive to the operation of the signaling device for modifying the stored program in accordance with the idle frequency of each oscillator measured when the coin is not in the vicinity of the sensors; and a microprocessor-controlled coin router, exclusively responsive to the frequency of each oscillator at a time when the coin is in the vicinity of the sensors and to the modified stored program for either routing the coin to the collection box or back to the user.

2. The telephone station of claim 1 wherein the signaling device comprises a switch that is operated when a handset, associated with the telephone station, is lifted.

3. The telephone station of claim 1 wherein the signaling device comprises a coin presence detector, positioned within the coin chute at or about the point of coin entry.

4. The telephone station of claim 1 wherein a temperature-dependent characteristic of the oscillator signal is its frequency, a first frequency being produced when the coin is away from the vicinity of the sensor and a second frequency being produced when the coin is in the vicinity of the sensor, coin acceptability being specified by an algorithm within the stored program which sets the limits of coin acceptance in accordance with the duration between zero-crossings of first frequency.

5. The telephone station of claim 4 wherein the duration between zero-crossings of the first frequency signal is measured by counting pulses of a higher frequency source-this pulse count being designated $C_{IDLE}$, and wherein the duration between zero-crossings of the second frequency signal is measured by counting pulses of the higher frequency source-this pulse count being designated $C_V$, and the algorithm relating the upper and lower acceptance limits of $C_V$ being specified as follows:

$$C_{VU}=k(\Delta C_{IDLE})+C_{VR}+T$$

$$C_{VL}=k(\Delta C_{IDLE})+C_{VR}-T$$

where:

k=constant of proportionality $\Delta C_{IDLE}$=the difference between $C_{IDLE}$ at a reference temperature and $C_{IDLE}$ at or about the time of coin authentication;

$C_{VR}=C_V$ as measured at a reference temperature; and

T=tolerance in the upper and lower limits

6. In combination:

an electronic coin chute having a generally unobstructed path between a coin entry region and either a collection box for acceptable coins or a coin return chute for unacceptable coins;

a microprocessor having a stored program for determining coin acceptability;

a pair of self-resonant oscillators operating at different frequencies, each including a coin quality sensor comprising a pair of coils positioned on opposite sides of the unobstructed path, each coil-pair generating an oscillating electromagnetic field in the coin path at a predetermined frequency, selected for measuring a property of a coin in the path;

means for measuring the frequency of each of the oscillators when the coin is not in the vicinity of the coil-pairs and modifying the stored program in accordance therewith;

means exclusively responsive to the measured frequency of each oscillator at a time when the coin is in the vicinity of its coil-pair, and to the modified stored program for either routing the coin to the collection box or to the return chute.

7. The combination of claim 6 further including a coin presence detector, positioned within the coin chute at or about the point of coin entry, the measurements of the frequency of the oscillators when the coin is not in the presence of the coil-pair commencing when the presence of a coin is detected.

8. A microprocessor-controlled electronic coin chute (ECC) having memory means storing coin acceptability criteria within a stored program for use in determining coin denomination, the ECC including first and second oscillators, each having a different resonant frequency that changes in response to the presence of a coin, coin denomination measurements being limited to the measurement of the frequencies of said first and second oscillators, the ECC further including means for changing coin acceptability criteria in accordance with changes in an environmentally-dependent parameter by modifying the stored program in accordance with the frequency of each oscillator measured when the coin is not in the presence of the oscillating circuits, said parameter being related to the frequency of the oscillating circuits.

9. The ECC of claim 8 wherein the frequency of the first oscillator is selected to measure a first predetermined characteristic of the coin; whereby changes in the frequency of said first oscillator caused by the presence of the coin are indicative of the first predetermined characteristic of the coin.

10. The ECC of claim 9 wherein the frequency of the second oscillator is selected to measure a second predetermined characteristic of the coin; whereby changes in the frequency of said second oscillator caused by the presence of the coin are indicative of the second predetermined characteristic of the coin.

11. The ECC of claim 8 wherein the environmentally-dependent parameter is ambient temperature.

12. The ECC of claim 10 wherein frequency changes of the first and second oscillators are compared with the acceptability criteria, the ECC further including means for accepting or rejecting coins based on the outcome of said comparison.

* * * * *